United States Patent [19]

Kneile

[11] 3,967,804

[45] July 6, 1976

[54] FRAME STRUCTURE FOR FURNITURE, ESPECIALLY TABLE FRAME STRUCTURE

[75] Inventor: Karl Kneile, Holzmaden, Teck, Germany

[73] Assignee: Robert Krause KG Zweiniederlassung Weilheim/Teck, Weilheim an der Teck, Germany

[22] Filed: Mar. 31, 1975

[21] Appl. No.: 563,364

[30] Foreign Application Priority Data

Mar. 30, 1974 Germany ..... 2415572

[52] U.S. Cl. ..... 248/188.2; 248/157; 108/138

[51] Int. Cl.[2] ..... F16M 11/24

[58] Field of Search ..... 248/188.1, 188.2, 188.6, 248/145, 162, 281, 157, 161, 421; 108/138, 145, 12, 17, 116, 144; 211/178 R

[56] References Cited

UNITED STATES PATENTS

| | | | |
|---|---|---|---|
| 2,406,436 | 8/1946 | Peter | 108/17 |
| 2,545,515 | 3/1951 | Gannett et al. | 108/138 |
| 2,894,562 | 7/1959 | Peller | 248/421 |
| 3,203,373 | 8/1965 | King | 108/138 |
| 3,792,668 | 2/1974 | Ward | 108/99 |
| 3,807,680 | 4/1974 | Wilson et al. | 248/421 |

*Primary Examiner*—James T. McCall
*Assistant Examiner*—Robert A. Hafer
*Attorney, Agent, or Firm*—Walter Becker

[57] ABSTRACT

A frame structure for furniture, especially table frame structure, according to which a first rigid support structure supports a pivotal support structure which is pivotally connected to the first rigid support structure for selective movement along a vertical plane from a first position of use in which it forms an upwardly directed extension of the first rigid support structure to a second position of use in which the pivotal support structure is folded downwardly at least approximately onto the first rigid support structure. The frame structure furthermore comprises a second rigid support structure which is pivotally supported by and extends upwardly from the pivotal support structure while forming with the latter a parallelogram linkage system, the pivotal support structure being adapted selectively to be locked to the second rigid support structure in the first position of use of the pivotal support structure.

23 Claims, 3 Drawing Figures

1
2
3
4
5
6
7
8
9
10
11
11
12
13
14
15
16
17
18
19
20
21
23
24
25
26
27

28
22
23
25
7
23
9
6
12
20
10
5
8
2
3
1

FRAME STRUCTURE FOR FURNITURE, ESPECIALLY TABLE FRAME STRUCTURE

The present invention relates to a furniture framework, especially table framework with a stand on which a support which is located substantially above said framework and is arrestable is movable from an upper position of use into a lower position of use especially against the thrust of a weight compensating spring or the like. With the heretofore known frameworks of the type involved, the support is linearly adjustably connected to said support for instance by telescopic columns. The adjustment of these heretofore known frameworks is, however, due to the required transmissions relatively time consuming. This is particularly disadvantageous when only one upper and one lower position of use are needed and these two positions of use have a relatively great distance as to height from each other.

It is, therefore, an object of the present invention to provide a furniture framework which will in a simple manner and safely permit a fast adjustment of the framework.

It is another object of this invention to provide a framework of the above mentioned type which will make it possible for the furniture piece provided with said framework that the respective furniture piece can be employed in its upper position of use as table and in its lower position of use as lounge, bed or the like, for instance for campers, boat cabins and the like.

These and other objects and advantages of the invention will appear more clearly from the following specification in connection with the accompanying drawings, in which.

The framework according to the present invention is characterized primarily in that the support with a parallelogram linkage system comprising at least approximately horizontal control axes is between its upper and lower positions of use pivotally mounted on a stand pertaining to the framework. In this way, with one pivoting movement, the respective position of use can be established in a minimum of time while the support when occupying its lower position of use is safely suspended on said parallelogram control members of said linkage system.

Figure 1:
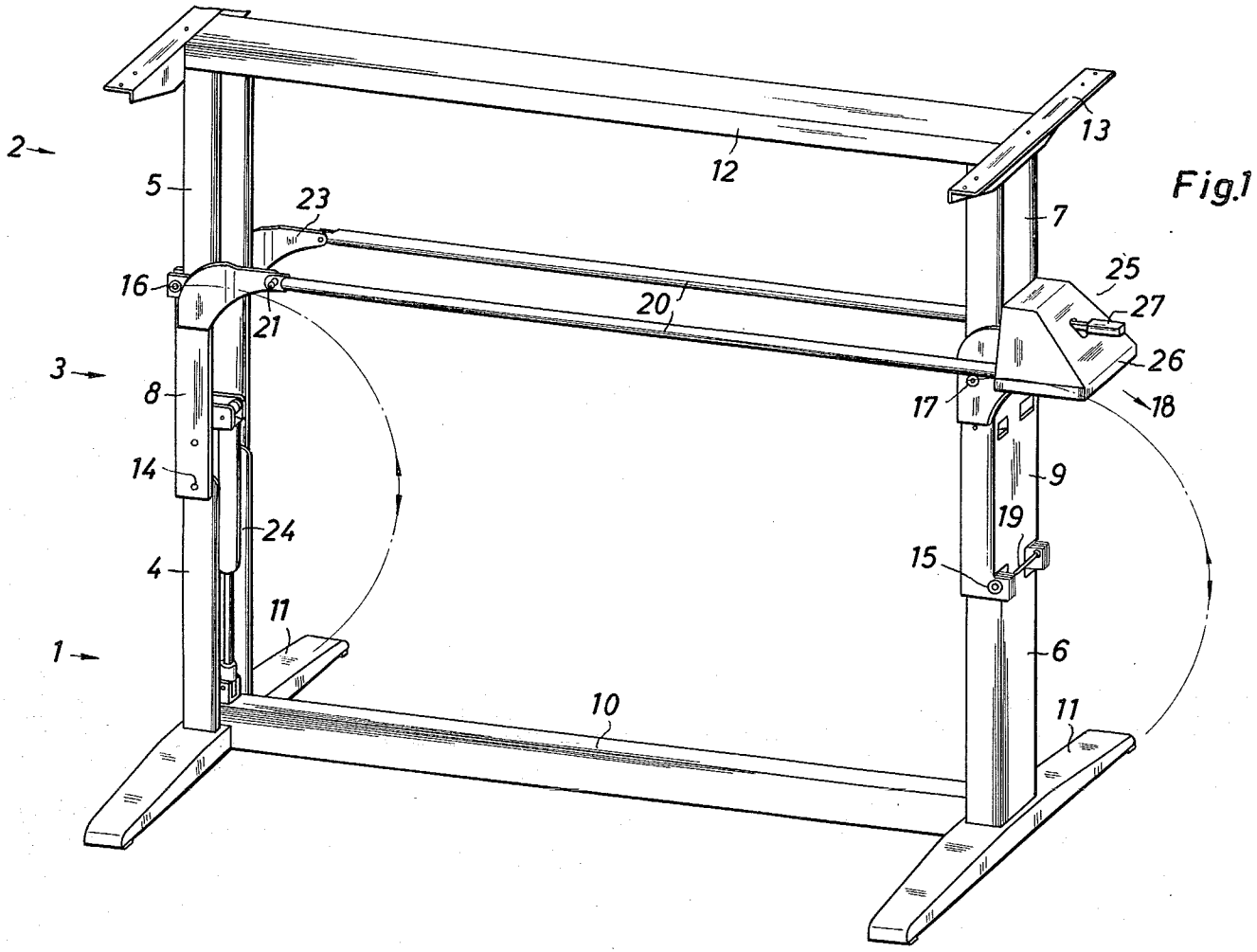
FIG. 1 illustrates an isometric view of a framework according to the present invention in its upper position of use.
Figure 2:
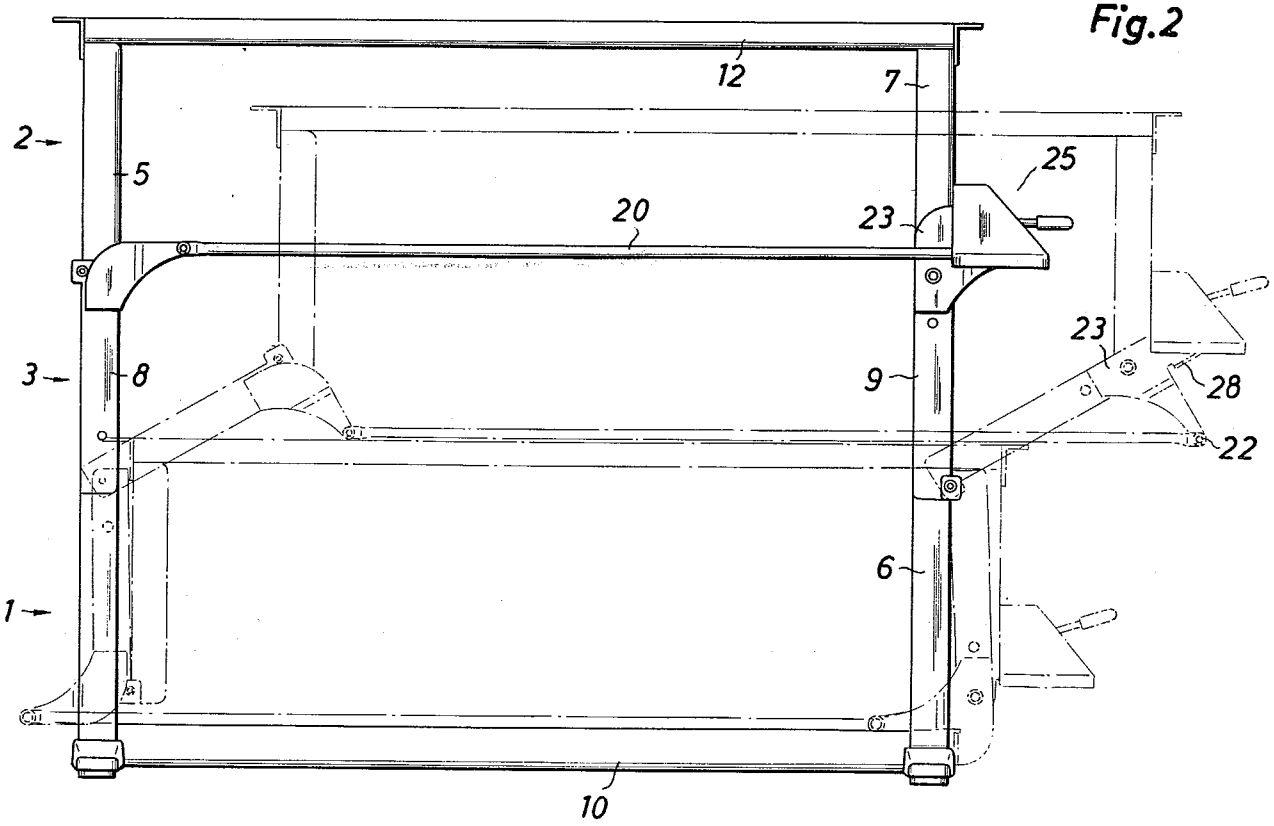
FIG. 2 shows a side view of a framework according to FIG. 1.
Figure 3:
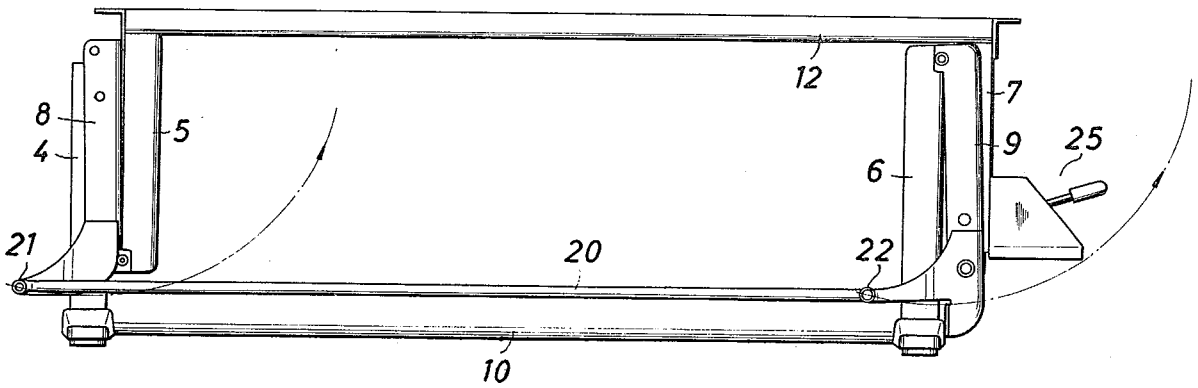
FIG. 3 shows the framework of FIG. 2 in its lower position of use.

Referring now to the drawings in detail, the furniture framework illustrated in FIGS. 1 - 3 comprises a stand 1 and a support 2 which through the intervention of a parallelogram linkage system 3 are pivotally connected to each other in such a way that the support 2 will with each pivot position of said parallelogram linkage system 3 be located in a horizontal plane.

The framework comprises two vertical supports which in the upper position of use of the framework extend over the entire maximum height of the framework. These vertical supports are located laterally at the ends of the framework and each of said supports comprises two support sections 4,5 and 6,7 respectively. Between said support sections 4,5 on one hand and 6,7 on the other hand there are provided parallelogram arms 8 and 9 which form a part of a parallelogram link system generally designated 3. The lower ends of the support sections 4,6 of the stand 1 are for purposes of increasing the rigidity of the framework interconnected by means of a longitudinal rail 10. In the specific embodiment illustrated in the drawings, the stand 1 has two feet 11 which in the manner of transverse struts are arranged at a right angle with regard to the rail 10 and are connected to the lower ends of the support sections 4,6. When the furniture framework is designed for connection to a separate support, to a wall or the like, the feet 11 will be superfluous. Those ends of the support sections 5 and 7 of the support 2 which face away from the joints of the support sections 5 and 7 with the parallelogram arms 8 and 9 respectively are for purposes of increasing the rigidity of the framework connected to each other by a longitudinal rail 12 which latter is expediently connected to the end surfaces of the support sections 5 and 7. At those outer ends of the support sections 5,7 which face away from each other there may be provided angular connecting fittings 13 the top sides of which are located in the plane of the top side of the longitudinal rail 12 and are intended for connecting thereto a furniture plate or the like.

Each parallelogram arm or lever 8 and 9 is by means of a horizontal shaft 14 and 15 which is perpendicular to the common vertical center plane of said two support sections 4,5 and 6,7 respectively pivotally connected to the pertaining support section 4,6 of stand 1. When the furniture framework occupies its upper position of use, these shafts 14 and 15 are located directly adjacent to the upper ends of said support sections 4 and 6 respectively and also directly adjacent to the lower ends of the parallelogram arms or levers 8 and 9 respectively. Parallelogram arm 8 and 9 has its pertaining upper end portion by means of a pivot shaft 16,17 respectively pivotally connected to the respective adjacent support section 5 and 7, said shafts 16 and 17 being parallel to each other and being respectively connected directly adjacent to the upper end of said arms 8 and 9 and directly adjacent to the lower ends of the support sections 5 and 7.

The support sections 4–7 are similar to the parallelogram arms or levers 8,9, of a U-shaped cross sectional profile. Expediently, all support sections 4–6 have the same cross sectional profile shape or profile dimensions. The parallelogram arms or levers 8,9 have greater profile dimensions than the support sections 4–7 so that the support sections 8,9 can extend over the outsides of the support sections 4–7. With the illustrated embodiment, the inner width between the profile legs of the parallelogram arms or levers 8,9 is greater than the corresponding outer width of the support sections 4–7 only by the necessary play of movement, while the support sections 4–7 are laterally overlapped by the parallelogram arms or levers 8,9. The rear parallelogram arm 8, when considering the direction of pivot movement along the arrow 18 from the upper position of use, may with its transverse web overlap the pertaining support sections 4,5 also on that outside which faces away from the other parallelogram arm 9. The other parallelogram arm 9, however, is in the upper position of use of the framework with that outside thereof which is formed by its profile transverse web and which faces away from the parallelogram arm 8 arranged expediently in abutment near the pertaining end surface of the support sections 6,7 or the profile transverse webs thereof while said end surfaces are advantageously located in the horizontal axial planes of the shafts 15, 17. Due to the overlapping design of the supporting sections and of the parallelogram arms, a very simple connection and high strength of the framework is obtained. The profile legs of the support sections 4–7 and of the parallelogram arms 8,9 are in the upper position of use of the framework facing each other so that relatively smooth outer surfaces of the two supports are obtained. The shaft 14 by means of which the rear parallelogram arm 8 (when considering the pivotal direction indicated by the arrow 18 from the upper position of use) is linked to the pertaining support section 4 of the stand 1, is, similar to the other shaft 16 of this parallelogram arm, offset outwardly relative to that side of the support section 4 which faces toward the other support and relative to the parallelogram arm 8 which faces toward the other support, offset toward the outside and with the specific embodiment illustrated is located approximately in the middle of the arm width of side support section 4 or of the parallelogram arm 8. The other shaft 16 is located on the outside of the parallelogram 8 or support section 5 and relative to these outsides is slightly offset in outward direction and provided on protruding bearing plates of the parallelogram arm and of the support section 5. Two bearing plates each of the parallelogram arm 8 and of the support section 5 are located directly adjacent and parallel to each other. The bearing plates of the support section 5 are provided on those inner sides of the bearing plates of the parallelogram linkage system 3 which are located in the planes of the profile legs of the parallelogram arm 8. A common joint bolt extends all the way through all of said bearing plates. The shaft 15 to which the front parallelogram arm 9 (when considering the pivot direction indicated by arrow 18 from the upper position of use) is linked to the pertaining support section 6 of the stand 1 is similar to the shaft 16, located on the outside of the supporting section 6 or of the parallelogram arm 9 and slightly offset outwardly relative to said outside, while a common joint bolt 19 extends through corresponding bearing plates. The shaft 17 by means of which the parallelogram arm 9 is linked to the pertaining support section 7 of the support 2 is offset outwardly relative to the inner side of the parallelogram arm 9 or the support section 7, and with the illustrated embodiment is similar to the shaft 14 located approximately in the middle between the outside and the inside of the parallelogram arm 9 or of the support section 7. The described design brings about that the parallelogram arm 8 in the lower position of use of the framework as shown in FIG. 3 on the inner side overlaps the support section 4 by means of its profile arm, whereas the pertaining support section 5 with the outside of its profile transverse web nearly engages the outside of the profile transverse web of arm 8 so that relatively little space will be needed.

In the lower position of use, the other parallelogram arm 9 has the outside of its profile web nearly engaging the outside of the support section 6 of the stand 1, whereas the support section 7 is located nearly completely within the parallelogram arm 9 and is laterally overlapped or straddled by the profile legs. The effective link of the support sections 4–7 and of the parallelogram arm 8 is nearly the same so that the support sections and the parallelogram arms 8,9 in the lower position of use according to FIG. 3 have their upper ends nearly located at the same level whereas the lower ends of the arms 8,9 and of the support sections 5,6 are located directly above the longitudinal rail 10 of the stand 1, and the rail 12 of support 2 is directly located above the upper ends of the support sections and of the parallelogram arms.

The two parallelogram arms 8,9 are interconnected by at least one, preferably by two connecting rods 20 which may have a cylindrical cross section. The ends of said connecting rods 20 are by means of transverse pins 21,22 which are parallel to the axes 14–17 linked to the parallelogram arms 8,9 and when viewing the framework from the top are located on both sides outside the parallelogram arms 8,9 or support sections 4–7 so that they will in no way impede the adjusting movement. The connecting rods 20 are in each pivoted position, located horizontally for obtaining a space-saving construction, while the pins 21, 22 provided on one parallelogram arm and pertaining to one connecting rod 20 are axially aligned with the respective pins 21,22 of the other connecting rod 20. Each parallelogram arm 8,9 has that end thereof which is linked to the pertaining support section 5, 7 of the support 2 provided with a nearly angular link plate 23 which protrudes in a direction transverse to the pertaining parallelogram arm 8,9 and at the protruding end is equipped with the pertaining pin 21,22 In the illustrated embodiment, the respective pin 21, 22 is offset in the longitudinal direction of the framework, with the respective position of use, relative to the pertaining parallelogram arm 8 and 9. In the upper position of use, the pins 21,22 are offset in the direction of the pivoting movement —arrow 18 — from this position of use relative to the parallelogram arms 8,9 by a distance greater than the profile height of said arms so that a high stability is obtained. The plates 23 are provided on the outside of the profile legs of the arms 8,9 and have the points 21,22 arranged in outwardly cranked end sections. In the lower position of use shown in FIG. 3, the plates or links 23 straddle the respective pertaining support section 4, 6 of the stand 1 on the side thereof. In the upper position of use, the pivot pins 21,22 are located at a level slightly above the level of the shaft 16,17 so that favorable lever conditions are obtained. In the lower position of use, the pivot pns 21,22 and the connecting rods 20 are located at a level directly above the level of the longitudinal rail 10 which is narrower than the distance between the connecting rods 20 and narrower than the support sections 4,6.

For purposes of balancing the weight, there is provided at least one weight-balancing spring 24 in the form of a lift-gas spring, a tension spring, a pressure spring or the like which will not interfere in any way when it is approximately vertical in the respective positions of use and which is preferably located within one of the two supports. The major length of said spring 24 is located between the profile legs of the pertaining support section 4 of stand 1 and has its lower end approximately at the level of the lower end of said support section 4 linked to the stand 1 by means of a pin which is parallel to the shafts 14, 15 respectively. In the specific illustrated embodiment, the lower end of spring 24 is linked to the top side of the pertaining end of the longitudinal rail 11. The upper end of spring 24 is in spaced relationship to the shaft 14 linked to the pertaining parallelogram arm by a pin parallel to the shafts 14,15 respectively, said last mentioned pin expediently being closer to the shaft 14, 15 respectively, said last mentioned pin expediently being closer to the shaft 14 than to the shaft 16. During the pivoting movement of the parallelogram arms 8,9 from the upper position of use through an angle of approximately 180° into the lower position of use, the spring 24, is gradually compressed while acting counter to the forces of the weight so that a shock-like lowering of the support 2 will be prevented. When pivoting the support upwardly from its lower position of use, the spring 24 aids the pivoting operation. In the lower position of use, the spring 24 is protected between the profile transverse webs of the support section 4 and the paralellogram arm 8.

For arresting the frame in its upper position of use, there is provided an arresting device 25 which includes a latch (not illustrated) which is arranged in housing 26 and is operable by a lever 27. The latch is mounted on the support 2 so that the lever 27 is always easily accessible. With the illustrated embodiment, the arresting device is arranged on the outside of the front support section 7 (when viewing the pivoting direction —arrow 18 — from the upper position of use) so that the support 2 during the shifting to the lower position of use can be particularly safely guided from the side of the arresting device. For the latch there is provided a latch countermember 28 (FIG. 2) which in a simple manner forms one piece with one of the pertaining plates 23. Both plates 23 of the parallelogram arm 9 may comprise latching countermembers. In the upper position of use, the latching countermember 28 is located at a level above the level of the pin 27 and on the outside of the parallelogram arm 9 or between the shaft 17 and the respective pertaining pin 22. In FIG. 2, the upper position of use is shown in heavy lines and the lower position of use as well as an intermediate position are indicated by dot-dash lines. In each position, the support sections 5,7 of the support 7 occupy a vertical position because they are rigidly connected to each other by the longitudinal rail 12.

It is, of course, to be understood that the present invention is, by no means, limited to the specific showing in the drawings but also comprises any modifications within the scope of the appended claims.

What I claim is:

1. A frame structure for furniture, especially table frame structure, which includes: a first rigid support structure, a pivotal support structure supported by and pivotally connected to said first rigid support structure for selective movement along a vertical plane from a first position of use in which it forms an upwardly directed extension of said first rigid support structure to a second position of use in which it is folded downwardly at least approximately onto said first rigid support structure, and vice versa, a second rigid support structure pivotally supported by and extending upwardly from said pivotal support structure while forming with the latter a parallelogram linkage system, said pivotal support structure including pivotal arms and pivot shafts pivotally connecting upper end portions of said first rigid support structure to the respective adjacent end portions of said arms, pin means parallel to said pivot shafts and respectively extending through to the other end portion of said arms, connecting rod means pivotally connected to said arms by said pin means, and additional pivot shafts parallel to said pivot shafts which pivotally connect said one end portion of said arms to said first rigid support and pivotally connecting said other end portion of said arms to the respective adjacent end portions of said second rigid support structure, said pin means being offset relative to the respective adjacent additional pivot shaft in the pivoting direction of said pivotal support structure from said first position of use to said second position of use, and in said first position of use of said pivotal support structure, said connecting rod means being located at a level higher than said additional pivot shafts.

2. A frame structure according to claim 1, in which said second rigid support structure has approximately the same height as said first rigid support structure.

3. A frame structure according to claim 1, in which said pivotal support-structure is shiftable from said first position of use by an angle of about 180° into the downwardly pending position.

4. A frame structure according to claim 1, in which said first rigid support structure comprises two stands respectively forming extensions of said pivotal arms when said pivotal support structure occupies said first position, and also comprises rail means rigidly interconnecting said stands.

5. A frame structure according to claim 1, in which said second rigid support structure includes uprights interconnected by rigid rail means and pivotally connected to said pivotal structure.

6. A frame structure according to claim 4, in which said pivotal arms are formed by profiled members.

7. A frame structure according to claim 6, in which said stands are formed by profiled members, and in which at least one of said last mentioned profiled members is operable in said second position of use of said pivotal structure to engage the respective adjacent pivotal arm.

8. A frame structure according to claim 6, in which said pivotal arms have a U-shaped cross sectional shape with the open end of said U's facing each other when said pivotal support structure occupies said first position.

9. A frame structure according to claim 7, in which said stands are channel members of U-shaped cross section.

10. A frame structure according to claim 6, in which said pivotal arms in said first position of said pivotal support structure straddle the upper end of the respective adjacent stand.

11. A frame structure according to claim 1, in which that one of said pivotal arms which when viewing the pivoting direction of said pivotal structure from said first position to said second position forms the rear pivotal arm has its pivotal shaft offset outwardly from support structure in the direction toward the pivotal shaft of the other pivotal arm.

12. A frame structure according to claim 1, in which that additional shaft which when viewing the direction of pivoting of said pivotal support structure from said first position of use to said second position of use pertains to the rear portion of said second rigid support structure is located on the backside externally of the respective adjacent pivotal arm.

13. A frame structure according to claim 1, in which that pivot shaft which when viewing the direction of pivoting said pivotal support structure from said first position of use to said second position of use pertains to the front portion of said pivotal support structure is located at said front portion on that side of the pivotal arm which faces toward the outside of said frame structure.

14. A frame structure according to claim 1, in which that pivotal shaft which when viewing the direction of pivoting said pivotal support structure from said first position of use to said second position of use pertains to the leading portion of said pivotal support structure is offset in said leading direction relative to the inner edge of the adjacent pivotal arm.

15. A frame structure according to claim 1, in which said pivotal arms and said first and second rigid support structures have approximately equal vertical extension when said pivotal support structure occupies said first position and are located at approximately the same level when said pivotal support structure occupies said second position.

16. A frame structure according to claim 1, in which said connecting rod means when viewing said frame structure from above are located laterally of said pivotal support structure when said pivotal support structure occupies said first position.

17. A frame structure according to claim 1, in which said connecting rod means include two connecting rods located on opposite sides of said pivotal frame structure when the latter occupies said first position.

18. A frame structure according to claim 1, in which those ends of said pivotal arms which are pivotally connected to said second rigid support structure include link plates for connection to said connecting rod means.

19. A frame structure according to claim 4, in which for purposes of weight compensation spring means are provided adjacent at least one of said stands and occupy in at least one of said two possible positions an approximately vertical position.

20. A frame structure according to claim 1, which includes means for selectively locking said pivotal support structure to said second rigid support structure in said first position of use of said pivotal support structure.

21. A frame structure according to claim 20, in which said means includes an arresting device comprising housing means connected to said second rigid support structure and also comprising handle means including a latching member and furthermore comprising receiving means connected to said pivotal structure for receiving said latching member to lock said pivotal structure to said second rigid support structure.

22. A frame structure according to claim 21, in which said pivotal support structure includes pivotal arms having those ends thereof which are adjacent said second rigid support structure provided with link plates pivotally connected thereto, and comprising said receiving means for receiving said latching member.

23. A frame structure for furniture, especially table frame structure, which includes: a first rigid support structure, a pivotal support structure supported by and pivotally connected to said first rigid support structure for selective movement along a vertical plane from a first position of use in which it forms an upwardly directed extension of said first rigid support structure to a second position of use in which it is folded downwardly at least approximately onto said first rigid support structure, and vice versa, a second rigid support structure pivotally supported by and extending upwardly from said pivotal support structure while forming with the latter a parallelogram linkage system, said pivotal support structure including pivotal arms and pivot shafts pivotally connecting upper end portions of said first rigid support structure to the respective adjacent end portions of said arms, pin means parallel to said pivot shafts and respectively extending through to the other end portion of said arms, connecting rod means pivotally connected to said arms by said pin means, additional pivot shafts parallel to said pivot shafts which pivotally connect said one end portion of said arms to said first rigid support and pivotally connecting said other end portion of said arms to the respective adjacent end portions of said second rigid support structure, said pin means being offset relative to the respective adjacent additional pivot shaft in the pivoting direction of said pivotal support structure from said first position of use to said second position of use, said first rigid support structure comprising two stands respectively forming extensions of said pivotal arms when said pivotal support structure occupies said first position, and also comprising rail means rigidly interconnecting said stands, and spring means provided adjacent at least one of said stands for purposes of weight compensation and occupying in at least one of said two possible positions an approximately vertical position, said spring means having one end connected to said first rigid support structure and having the other end thereof connected to said pivotal support structure.

* * * * *